US011637388B2

(12) United States Patent
Schuster et al.

(10) Patent No.: US 11,637,388 B2
(45) Date of Patent: Apr. 25, 2023

(54) FERRULE FOR A COAXIAL CABLE TERMINAL HAVING OVERLAPPING CRIMP WINGS

(71) Applicant: Aptiv Technologies Limited, St. Michael (BB)

(72) Inventors: James P. Schuster, Vienna, OH (US); Luke Bucey, McDonald, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/511,726

(22) Filed: Oct. 27, 2021

(65) Prior Publication Data

US 2023/0092717 A1 Mar. 23, 2023

Related U.S. Application Data

(60) Provisional application No. 63/245,327, filed on Sep. 17, 2021.

(51) Int. Cl.

| | |
|---|---|
| ***H01R 9/05*** | (2006.01) |
| ***H01R 43/048*** | (2006.01) |
| ***H01R 4/2495*** | (2018.01) |

(52) U.S. Cl.
CPC ..... *H01R 9/0518* (2013.01); *H01R 4/2495* (2013.01); *H01R 43/048* (2013.01)

(58) Field of Classification Search
CPC ... H01R 9/0518; H01R 4/2495; H01R 43/048
See application file for complete search history.

(56) References Cited

U.S. PATENT DOCUMENTS

| | | | | |
|---|---|---|---|---|
| 3,484,922 | A * | 12/1969 | Schwalm | H01R 43/048 29/517 |
| 6,808,416 | B2 | 10/2004 | Fegley et al. | |
| 7,635,282 | B2 * | 12/2009 | Sakamoto | H01R 9/0518 439/585 |
| 9,667,000 | B1 | 5/2017 | Morello et al. | |
| 10,770,840 | B1 * | 9/2020 | Garver | H01R 13/6592 |
| 11,024,984 | B2 | 6/2021 | Blumenshein et al. | |
| 2009/0098769 | A1 * | 4/2009 | Sakamoto | H01R 9/0518 439/578 |
| 2014/0273594 | A1 | 9/2014 | Jones et al. | |
| 2017/0222349 | A1 * | 8/2017 | Kleymann | H01R 13/64 |
| 2020/0127421 | A1 * | 4/2020 | Jones | H01R 9/053 |

FOREIGN PATENT DOCUMENTS

EP 3641061 * 4/2020

* cited by examiner

*Primary Examiner* — Jean F Duverne
(74) *Attorney, Agent, or Firm* — Billion & Armitage

(57) ABSTRACT

A coaxial cable assembly includes a coaxial cable having a shield conductor surrounding a central conductor, a shield terminal in contact with an inner surface of the shield conductor, and a ferrule configured to secure the shield terminal to the coaxial cable. The ferrule defines first and second crimping wings. The first and second crimping wings each having an arcuate shape and are compressively connected to an outer surface of the shield conductor. A distal end of the first crimping wing overlies a distal end of the second crimping wing. A method for forming the coaxial cable assembly and a crimping tool for attaching the ferrule to the coaxial cable is also provided.

18 Claims, 5 Drawing Sheets

FERRULE FOR A COAXIAL CABLE TERMINAL HAVING OVERLAPPING CRIMP WINGS

CROSS-REFERENCE TO RELATED APPLICATION

This application claims the benefit under 35 U.S.C. § 119(e) of U.S. Provisional Patent Application No. 63/245,327 filed on Sep. 17, 2021, the entire disclosure of which is hereby incorporated by reference.

TECHNICAL FIELD

This invention relates to a ferrule for a coaxial cable terminal having overlapped crimping wings, a method of crimping the crimping wings of the ferrule so that they overlap, and a tool for crimping the crimping wings of the ferrule so that they overlap.

BACKGROUND

Previous coaxial terminal designs included a tubular ferrule that was formed using a drawing process to secure the coaxial terminal to the shield conductor of the coaxial cable. These tubular ferrules were relatively expensive to produce because they were formed using deep draw stamping or extrusion processes. In addition, because these ferrules are formed individually, they are not well suited for automated assembly, further increasing assembly cost by requiring manual placement of the ferrule prior to crimping. More recent designs for the shield ferrule included a ferrule formed with a pair of bypassing crimping wings. These "bypass" ferrules can be formed from sheet metal using a stamping process and may include a carrier strip that allows automated crimping of the ferrule onto the coaxial cable. However, these "bypass" ferrules lack sufficient column strength to provide the desired mechanical force to meet requirements for the ferrule. Additionally, these "bypass" ferrules have a higher risk of loose braid strands of the shield conductor sticking out from the ferrule after the ferrule is applied to the shield conductor.

BRIEF SUMMARY

According to one or more aspects of the present disclosure, a coaxial cable assembly includes a coaxial cable having a shield conductor surrounding a central conductor, a shield terminal in contact with an inner surface of the shield conductor, and a ferrule configured to secure the shield terminal to the coaxial cable. The ferrule defines first and second crimping wings that each have an arcuate shape and re compressively connected to an outer surface of the shield conductor. A distal end of the first crimping wing overlies a distal end of the second crimping wing.

In one or more embodiments of the coaxial cable assembly according to the previous paragraph, the ferrule further comprises a pair of retention wings, each having an arcuate shape and compressively connected to an insulation layer surrounding the shield conductor.

In one or more embodiments of the coaxial cable assembly according to any one of the previous paragraphs, distal ends of the pair of retention wings define pointed tabs that pierce the insulation layer.

In one or more embodiments of the coaxial cable assembly according to any one of the previous paragraphs, the arcuate shape of the first crimping wing has a first radius and the arcuate shape of the second crimping wing has a second radius that is less than the first radius.

In one or more embodiments of the coaxial cable assembly according to any one of the previous paragraphs, the distal end of the first crimping wing completely overlies the distal end of a second crimping wing.

In one or more embodiments of the coaxial cable assembly according to any one of the previous paragraphs, an inner surface of the ferrule defines a knurled surface having a plurality of recesses and wherein the plurality of protrusions is arranged on perimeter edges of the plurality of recesses.

In one or more embodiments of the coaxial cable assembly according to any one of the previous paragraphs, each recess in the plurality of recesses is rhombus shaped.

According to one or more aspects of the present disclosure, a method of attaching a ferrule to a shield conductor of a coaxial cable includes providing the ferrule having a pair of crimping wings and compressively attaching the ferrule to the shield conductor by forming the pair of crimping wings into arcuate shapes such that a distal end of a first crimping wing in the pair of crimping wings overlies a distal end of a second crimping wing in the pair of crimping wings.

In one or more embodiments of the method according to the previous paragraph, the forming the pair of crimping wings into arcuate shapes is performed using a crimping tool having two asymmetrical lobes having unequal radii.

In one or more embodiments of the method according to any one of the previous paragraphs, the crimping tool forms the pair of crimping wings such that the formed first crimping wing has a first radius and the formed second crimping wing has a second radius that is less than the first radius.

In one or more embodiments of method according to any one of the previous paragraphs, centers of the unequal radii are offset from one another.

In one or more embodiments of the method according to any one of the previous paragraphs, the ferrule further includes a pair of retention wings having distal ends that define pointed tabs and the method further includes forming the pair of retention wings into arcuate shapes such that the pointed tabs pierce an insulation layer surrounding the shield conductor.

In one or more embodiments of the method according to any one of the previous paragraphs, an inner surface of the ferrule defines a knurled surface having a plurality of recesses and wherein the plurality of protrusions is arranged on perimeter edges of the plurality of recesses.

In one or more embodiments of the method according to any one of the previous paragraphs, each recess in the plurality of recesses is rhombus shaped.

According to one or more aspects of the present disclosure, a crimping tool is configured to compressively attach ferrule having first and second crimping wings to a shield of a coaxial cable by forming pair of crimping wings into arcuate shapes such that a distal end of the first crimping wing completely overlies a distal end of the second crimping wing. The crimping tool includes a crimping plate having a pair of asymmetrical lobes. A first radius of a first lobe of the pair of asymmetrical lobes is less than a second radius of a second lobe of the pair of asymmetrical lobes.

In one or more embodiments of the crimping tool according to the previous paragraph, the first lobe is configured to form the first crimping wing and the second lobe is configured to form the second crimping wing.

In one or more embodiments of the crimping tool according to any one of the previous paragraphs, a center of the first radius of the first lobe is offset from a center of the second radius of the second lobe.

In one or more embodiments of the crimping tool according to any one of the previous paragraphs, an arc length of the first lobe is less than an arc length of the second lobe.

In one or more embodiments of the crimping tool according to any one of the previous paragraphs, an intersection of the first lobe with the second lobe is offset from a centerline of the crimping plate.

BRIEF DESCRIPTION OF THE DRAWINGS

The present invention will now be described, by way of example with reference to the accompanying drawings, in which.

DETAILED DESCRIPTION

Figure 1:
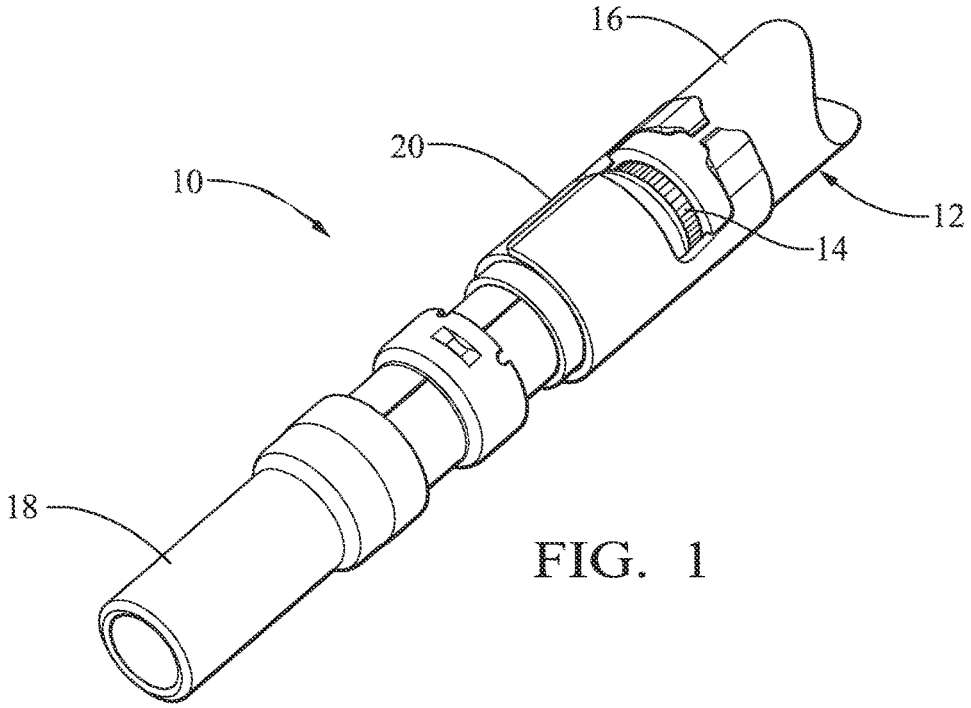
FIG. 1 shows a perspective view of an electrical terminal having a ferrule with overlapping crimp wings contacting the shield of the coaxial cable according to some embodiments.
Figure 2A:
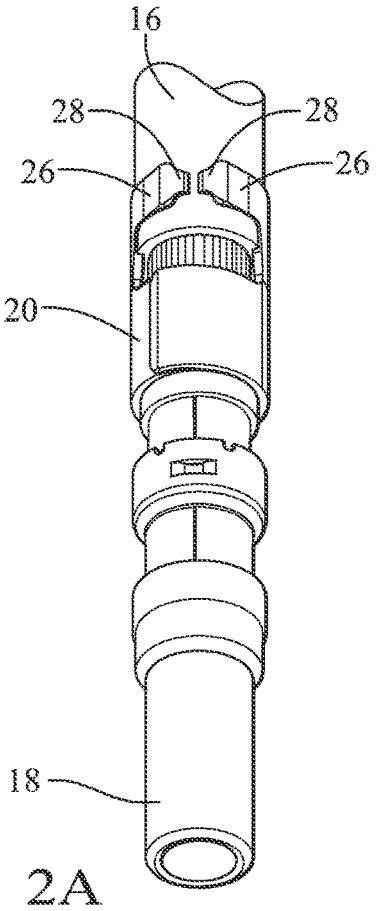
FIGS. 2A and 2B show alternative perspective views of the electrical terminal of FIG. 1 according to some embodiments.
Figure 2B:
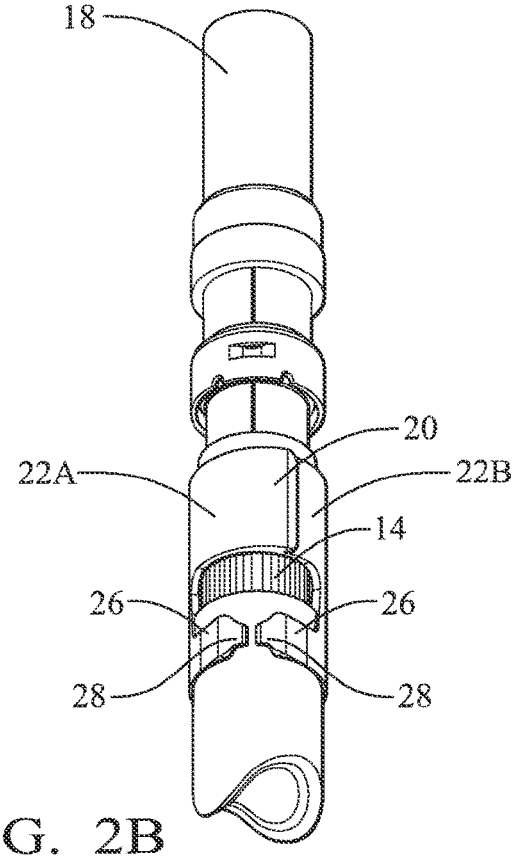
Figure 3A:
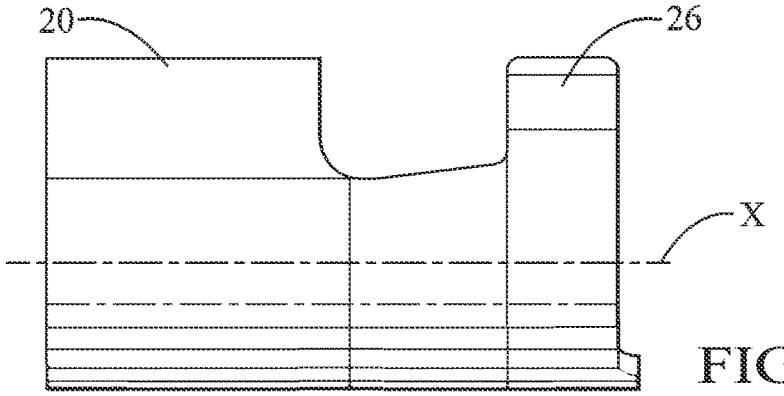
FIG. 3A shows a side view of the ferrule in a pre-crimped condition according to some embodiments.
Figure 3B:
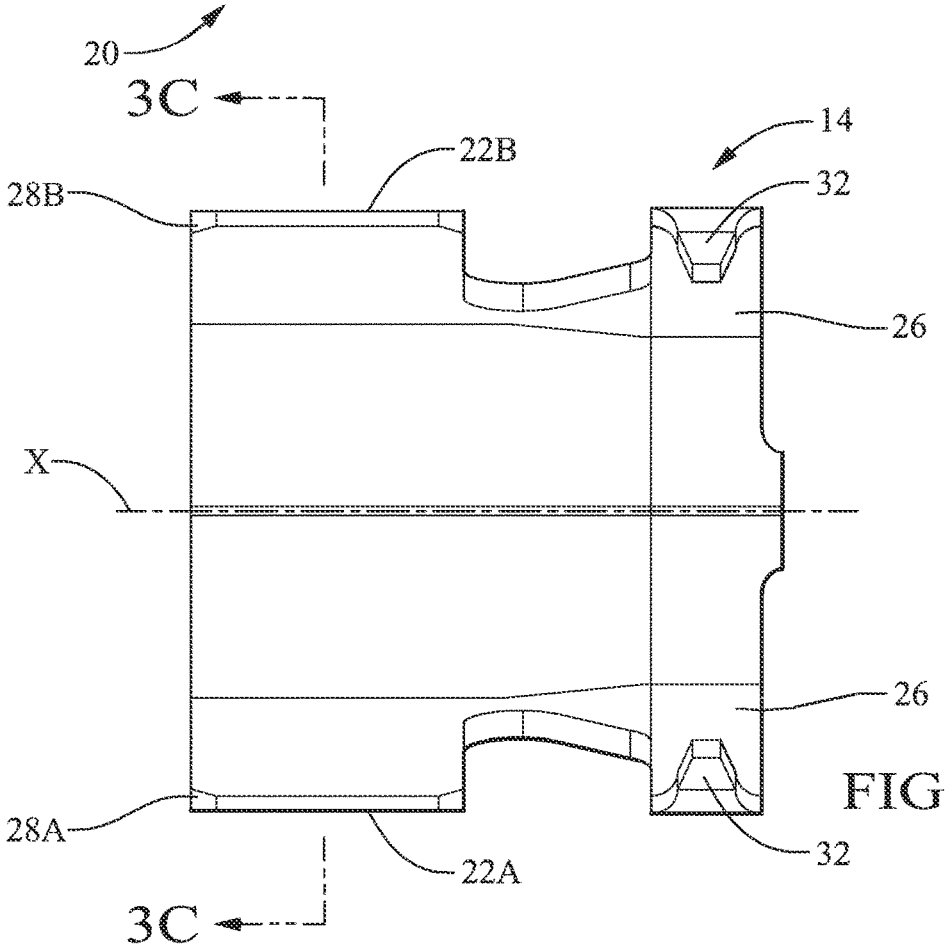
FIG. 3B shows a top view of the ferrule in the pre-crimped condition according to some embodiments.
Figure 3C:
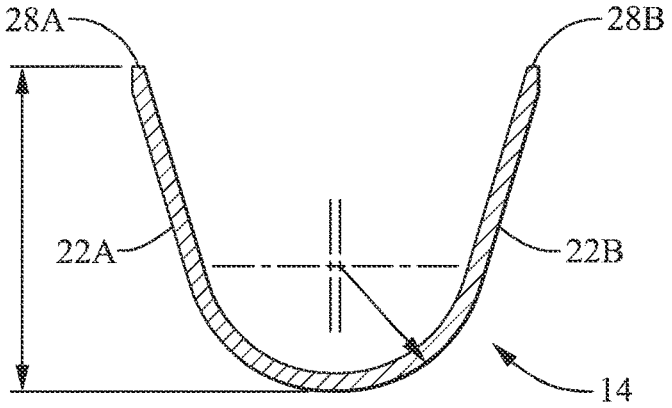
FIG. 3C shows a cross-section view of the ferrule in the pre-crimped condition according to some embodiments.
Figure 4A:
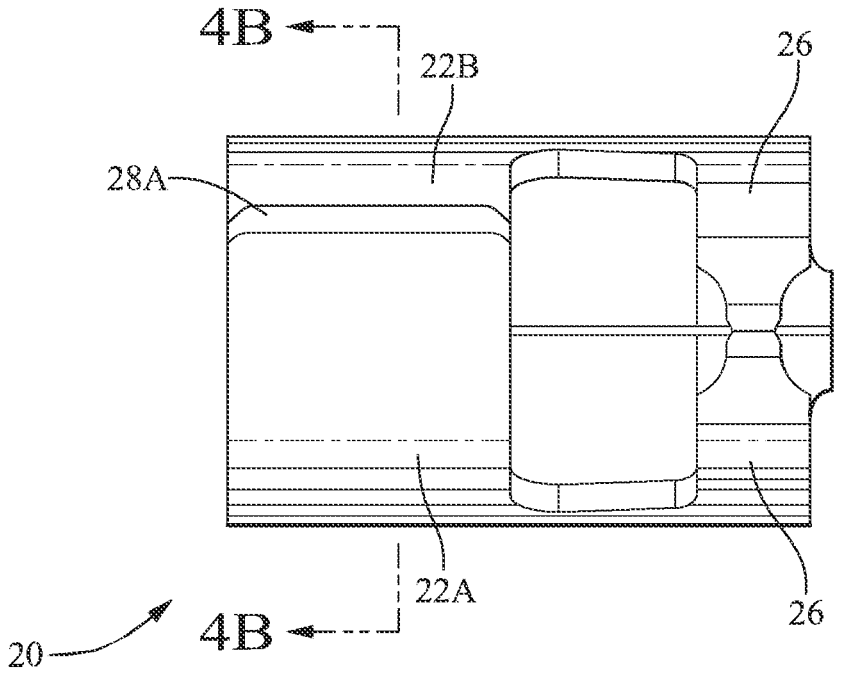
FIG. 4A shows a top view of the ferrule in a crimped condition according to some embodiments.
Figure 4B:
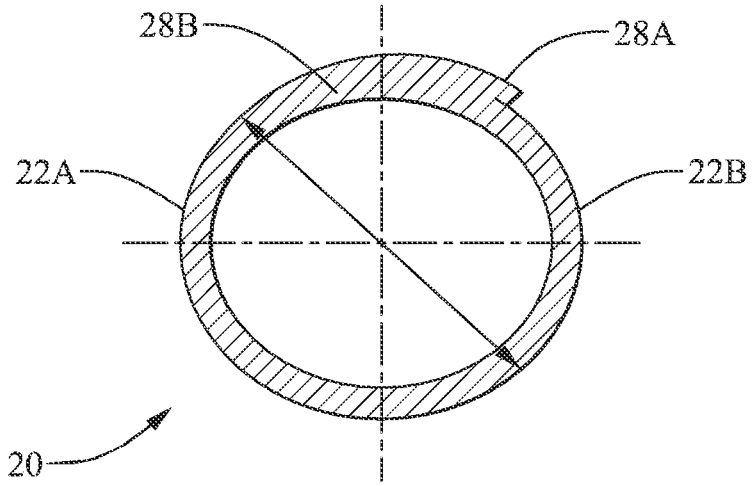
FIG. 4B shows a cross-section view of the ferrule in the crimped condition according to some embodiments.

A non-limiting example of a coaxial cable assembly 10 illustrated in FIGS. 1, 2A, and 2B includes a coaxial cable 12 having the typical construction of a central conductor (not shown) surrounded by an inner insulation layer (not shown) and a braided shield conductor 14 surrounded by an outer insulation layer 16. The coaxial cable assembly, hereinafter referred to as the assembly 10, includes a shield terminal 18 that is used to terminate the shield conductor 14. The shield terminal 18 includes a separate shield ferrule 20 which wraps around the exposed shield conductor 14 of the coaxial cable 12. The shield ferrule 20 is formed from a flat sheet of metal by a stamping process and is then bent to form the shape shown in FIGS. 3A-3C. The shield ferrule 20 has two opposed crimping wings 22A, 22B. The crimping wings are crimped around the shield conductor 14 by forming the crimping wings into arcuate shapes and compressively contacting the shield conductor such that a distal end 28A of one of the crimping wings 22A completely overlies a distal end 28B of the other crimping wing 22B as shown in FIGS. 4A and 4B. As used herein, the term "completely overlies" means that the side edges of the distal ends 28A, 28B are congruent. There is no gap between the crimping wings 22A, 22B at the distal end 28B and there is preferably no gap between the crimping wings 22A, 22B at the distal end 28A. A radius R1 of the arcuate shape of the crimping wing 22A is greater than a radius R2 of the arcuate shape of the crimping wing 22B. Although not shown in the drawings, the shield ferrule 20 may include a carrier strip that allows automated crimping of the ferrule onto the coaxial cable using an automated crimping tool.

The shield ferrule 20 also includes a pair of retention wings 26 that are wrapped around the outer insulation layer 16 of the coaxial cable 12. The ends of the retention wings 26 may define points 28 that are configured to penetrate the outer insulation layer 16 as shown in FIGS. 4A and 4B. These retention wings 26 are configured to more securely attached the ferrule to the coaxial cable and to prevent rotation of the shield ferrule 20 and the shield terminal around the axis of the coaxial cable.

Figure 5:
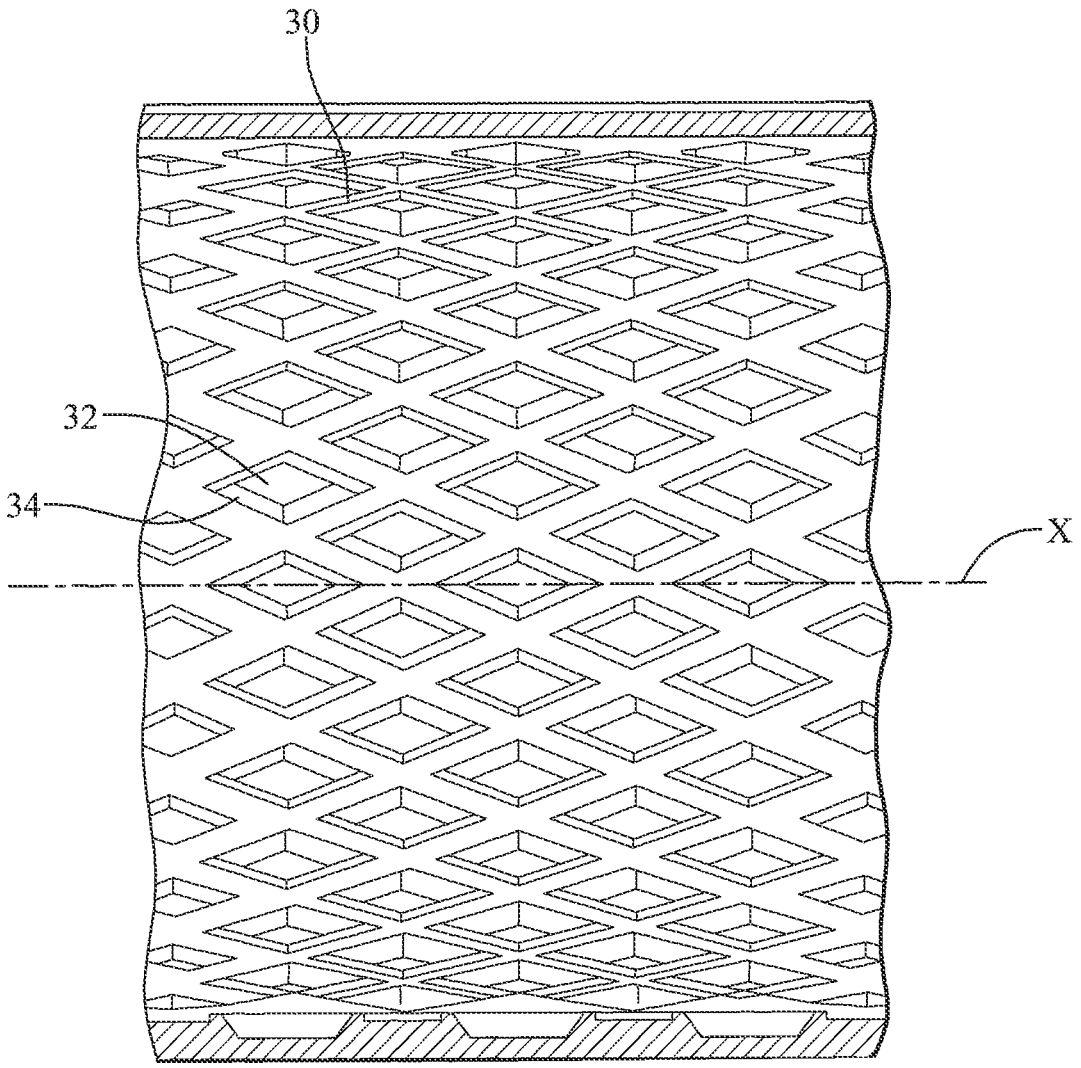
FIG. 5 shows a side view of a crimping tool used to form the overlapping crimp wings according to some embodiments.

The inner surface 30 of the shield ferrule 20 is knurled to define a plurality of recesses as shown in FIG. 5. In the illustrated example the knurling is a plurality of rhombus-shaped recesses 32, that are surrounded by a plurality of protrusions 34 extending above the inner surface. This plurality of protrusions 34 is formed by the displacement of material caused by the knurling process. The height of the protrusions 34 created by the knurling process is fairly random so that the plurality of protrusions 34 has a nonuniform height. Due to the rhombic shape of the recesses 32, the height of the protrusions 34 above the inner surface 30 varies around the perimeter of the recesses 32 due to more material being displaced near the obtuse angled corners of the recesses 32 than at the acute angled corners of the recesses 32. The height of the protrusions 34 above the inner surface 30 may also vary due to tolerance variations in the knurling process. The rhombus-shaped recesses 32 are arranged in offset rows and columns such that major axes of the rhombus-shaped recesses are aligned generally parallel to the longitudinal axis X of the shield ferrule 20 and minor axes of the rhombus-shaped recesses 32 are aligned generally perpendicular to the longitudinal axis X of the shield ferrule 20. As used herein "generally" parallel or perpendicular means±10° of absolutely parallel or perpendicular.

Figure 6:
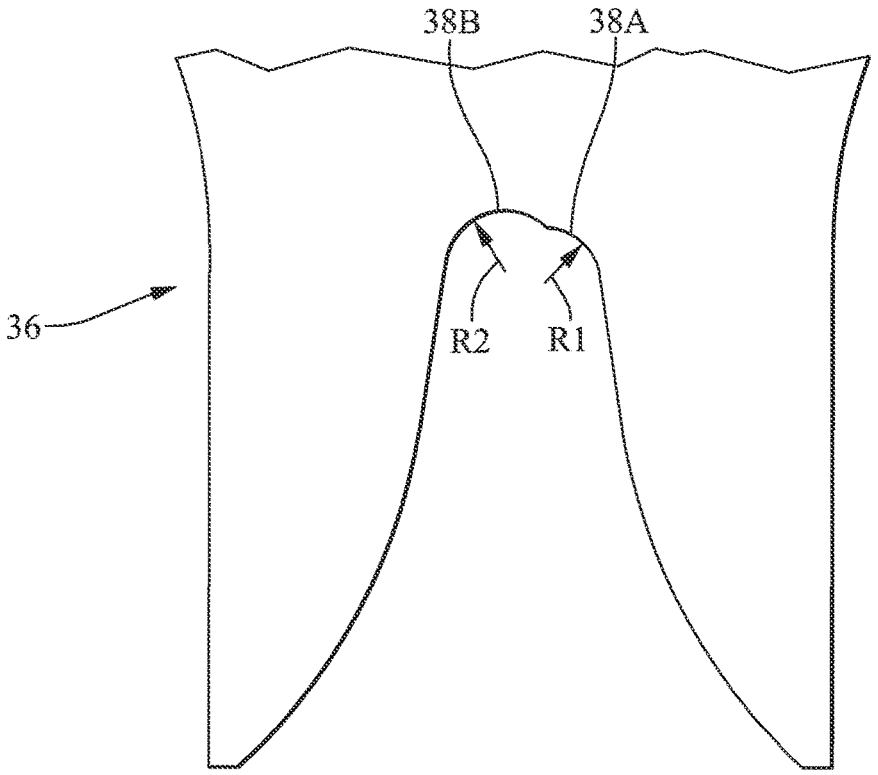
FIG. 6 shows a side view of a crimping tool used to form the overlapping crimp wings according to some embodiments.

The crimping wings 22A, 22B may be formed into the overlapping arcuate shapes by a crimping tool having an asymmetrical crimping plate 36 as illustrated in FIG. 6. The crimping plate 36 has two lobes 38A, 38B each having a different radius R1, R2. The radius R1 of the first lobe 38A is less than radius R2 of the second lobe 38B. In addition, the center of the radius R1 is offset from the center of radius R2. Further, an arc length of the first lobe 38A is less than an arc length of the second lobe 38B. The first lobe 38A is configured to form the first crimping wing 22A and the second lobe 38B is configured to form the second crimping wing 22B. The different radii, offset centers and different arc lengths of the first and second lobes 38A, 38B cooperate to form the first and second crimping wings 22A, 22B so that the distal end 28A of one crimping wing 22A overlies the distal end 28B of crimping wing 22B. The crimping tool may include a movable crimping plate 36 and a conventional fixed crimping anvil (not shown). The crimping tool is preferably automated for high volume production but may also be a manual crimping tool used for low volume engineering builds and/or cable repair.

Figure 7:
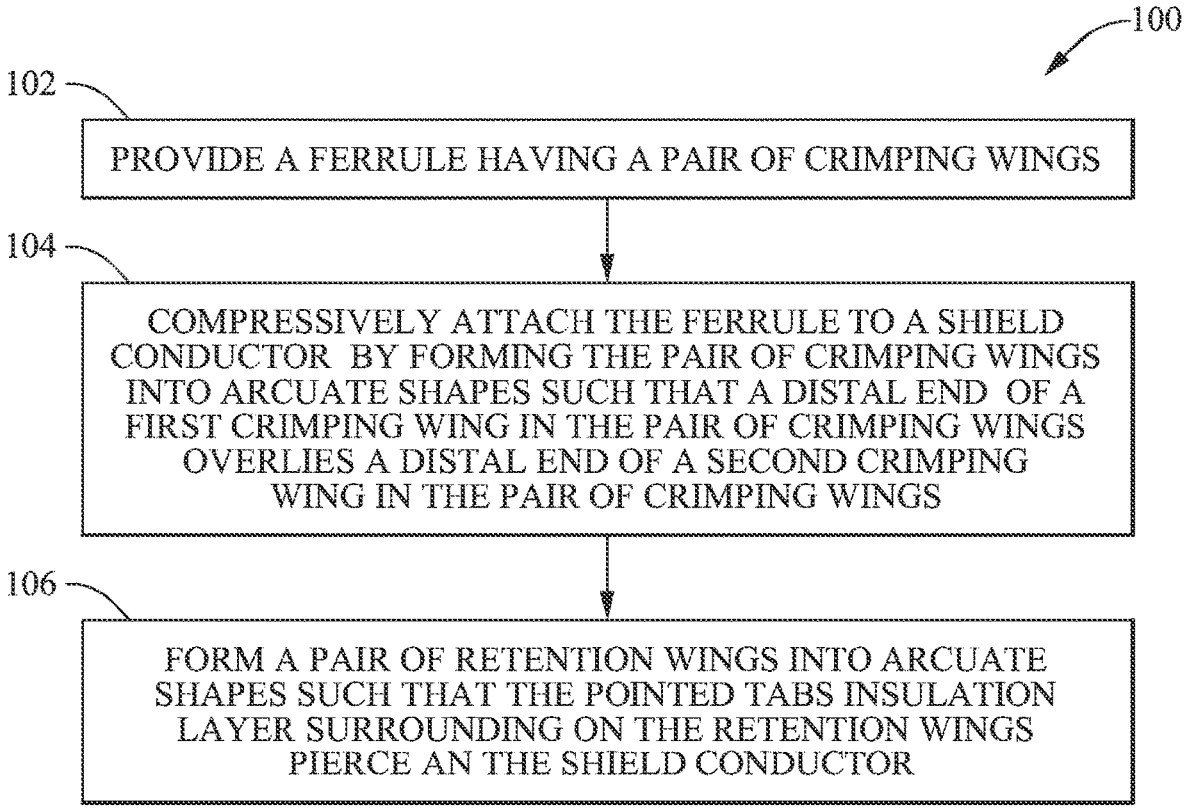
FIG. 7 shows a flow chart of a method of method of attaching a ferrule to a shield conductor of a coaxial cable according to some embodiments.

A method 100 of attaching a ferrule to a shield conductor of a coaxial cable is illustrated in FIG. 7. The method 100 includes the following steps:

STEP 102, PROVIDE A FERRULE HAVING A PAIR OF CRIMPING WINGS, includes providing a shield ferrule 20 having a pair of crimping wings 22A, 22B;

STEP 104, COMPRESSIVELY ATTACH THE FERRULE TO A SHIELD CONDUCTOR BY FORMING THE PAIR OF CRIMPING WINGS INTO ARCUATE SHAPES SUCH THAT A DISTAL END OF A FIRST CRIMPING WING IN THE PAIR OF CRIMPING WINGS OVERLIES A DISTAL END OF A SECOND CRIMPING WING IN THE PAIR OF CRIMPING WINGS, includes compressively attaching the shield ferrule 20 to the shield conductor 14 by forming the pair of crimping wings 22A, 22B into arcuate shapes such that a distal end 28A of a first crimping wing 22A in the pair of crimping wings 22A, 22B overlies a distal end 28B of a second crimping wing 22B in the pair of crimping wings 22A, 22B; and STEP 106, FORM A PAIR OF RETENTION WINGS INTO ARCUATE SHAPES SUCH THAT THE POINTED TABS INSULATION LAYER SURROUNDING ON THE RETENTION WINGS PIERCE AN THE SHIELD CONDUCTOR, includes forming the pair of retention wings into arcuate shapes such that the pointed tabs pierce an insulation layer surrounding the shield conductor 14.

The shield ferrule 20 presented herein provides the benefit of introducing an additional contact surface of terminal material to aid in retention force. The overlapping crimping wings 22A, 22B on the shield ferrule 20 also reduces the potential for loose braid strands of the shield conductor 14 to extend from the shield ferrule 20 by eliminating any circumferential seams in the crimped region. The shield ferrule 20 increases the crimping surface area, compared to bypass ferrule designs, for increased functionality of the of rhombus-shaped recesses 32 and protrusions 34. The shield ferrule 20 provides increased mechanical performance over the to bypass ferrule designs. The shield ferrule 20 provides improved radio frequency (RF) performance compared to the bypass ferrule designs. This shield ferrule 20 is applicable to both RF signal coaxial cable assemblies as well as high voltage shielded coaxial cable assemblies.

While the invention has been described with reference to an exemplary embodiment(s), it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

The invention claimed is:

1. A coaxial cable assembly, comprising:

a coaxial cable having a shield conductor surrounding a central conductor;

a shield terminal in contact with an inner surface of the shield conductor; and a ferrule configured to secure the shield terminal to the coaxial cable, the ferrule defining first and second crimping wings each having an arcuate shape and compressively connected to an outer surface of the shield conductor, wherein a first distal end of the first crimping wing overlies a second distal end of the second crimping wing, wherein side edges of the first distal end are congruent with side edges of the second distal end of the second crimping wing, and wherein there is no gap between the first crimping wing and the second distal end.

2. The coaxial cable assembly according to claim 1, wherein the ferrule further comprises a pair of retention wings, each having an arcuate shape and compressively connected to an insulation layer surrounding the shield conductor.

3. The coaxial cable assembly according to claim 2, wherein distal ends of the pair of retention wings define pointed tabs that pierce the insulation layer.

4. The coaxial cable assembly according to claim 1, wherein the arcuate shape of the first crimping wing has a first radius and the arcuate shape of the second crimping wing has a second radius that is less than the first radius.

5. The coaxial cable assembly according to claim 1, wherein an inner surface of the ferrule defines a knurled surface having a plurality of recesses and wherein a plurality of protrusions is arranged on perimeter edges of the plurality of recesses.

6. The coaxial cable assembly according to claim 5, wherein each recess in the plurality of recesses is rhombus shaped.

7. A method of attaching a ferrule to a shield conductor of a coaxial cable, comprising:

providing the ferrule having a pair of crimping wings; and compressively attaching the ferrule to the shield conductor by forming the pair of crimping wings into arcuate shapes such that a first distal end of a first crimping wing in the pair of crimping wings overlies a distal end of a second crimping wing in the pair of crimping wings, side edges of the first distal end are congruent with side edges of the second distal end of the second crimping wing, and there is no gap between the first crimping wing and the second distal end.

8. The method according to claim 7, wherein the forming the pair of crimping wings into arcuate shapes is performed using a crimping tool having two asymmetrical lobes having unequal radii.

9. The method according to claim 8, wherein the crimping tool forms the pair of crimping wings such that the formed first crimping wing has a first radius and the formed second crimping wing has a second radius that is less than the first radius.

10. The method according to claim 8, wherein centers of the unequal radii are offset from one another.

11. The method according to claim 7, wherein the ferrule further includes a pair of retention wings having distal ends that define pointed tabs and wherein the method further includes:

forming the pair of retention wings into arcuate shapes such that the pointed tabs pierce an insulation layer surrounding the shield conductor.

12. The method according to claim 7, wherein an inner surface of the ferrule defines a knurled surface having a plurality of recesses and wherein a plurality of protrusions is arranged on perimeter edges of the plurality of recesses.

13. The method according to claim 12, wherein each recess in the plurality of recesses is rhombus shaped.

14. A crimping tool configured to compressively attach ferrule having first and second crimping wings to a shield of a coaxial cable by forming pair of crimping wings into arcuate shapes such that a first distal end of the first crimping wing overlies a second distal end of the second crimping wing side edges of the first distal end are congruent with side edges of the second distal end of the second crimping wing, and there is no gap between the first crimping wing and the second distal end, the crimping tool comprising:

a crimping plate having a pair of asymmetrical lobes, wherein a first radius of a first lobe of the pair of asymmetrical lobes is less than a second radius of a second lobe of the pair of asymmetrical lobes.

15. The crimping tool according to claim 14, wherein the first lobe is configured to form the first crimping wing and the second lobe is configured to form the second crimping wing.

16. The crimping tool according to claim 14, wherein a center of the first radius of the first lobe is offset from a center of the second radius of the second lobe.

17. The crimping tool according to claim 14, wherein an arc length of the first lobe is less than an arc length of the second lobe.

18. The crimping tool according to claim 14, wherein an intersection of the first lobe with the second lobe is offset from a centerline of the crimping plate.

* * * * *